United States Patent [19]

Eriksson

[11] 3,946,991

[45] Mar. 30, 1976

[54] VEHICLE WINCH

[75] Inventor: Erik Eriksson, Vansbro, Sweden

[73] Assignee: Sepson AB, Vansbro, Sweden

[22] Filed: July 12, 1974

[21] Appl. No.: 488,211

[52] U.S. Cl. ..... 254/166; 242/86.5 R

[51] Int. Cl.[2] ..... B66D 3/00

[58] Field of Search ..... 254/166, 139.1; 242/86.8, 242/86.5

[56] References Cited

UNITED STATES PATENTS

| | | | |
|---|---|---|---|
| 1,727,678 | 9/1929 | Stedelin et al. | 254/166 |
| 1,845,171 | 2/1932 | Mendenhall | 254/166 |
| 2,545,795 | 3/1951 | Roos | 254/166 |
| 2,703,220 | 3/1955 | Curtiss | 254/166 |
| 2,704,191 | 3/1955 | Schley et al. | 254/166 |

*Primary Examiner*—Robert J. Spar
*Assistant Examiner*—Kenneth Noland
*Attorney, Agent, or Firm*—Oldham & Oldham Co.

[57] ABSTRACT

A vehicle winch comprising a cable drum and a winch operating device arranged in operating engagement with said cable drum via a transversely extending transmission shaft mounted in bearings supported by the ordinary side beams of the vehicle chassis. The cable drum and the winch operating device being external of a respective one of the frame side beams.

7 Claims, 1 Drawing Figure

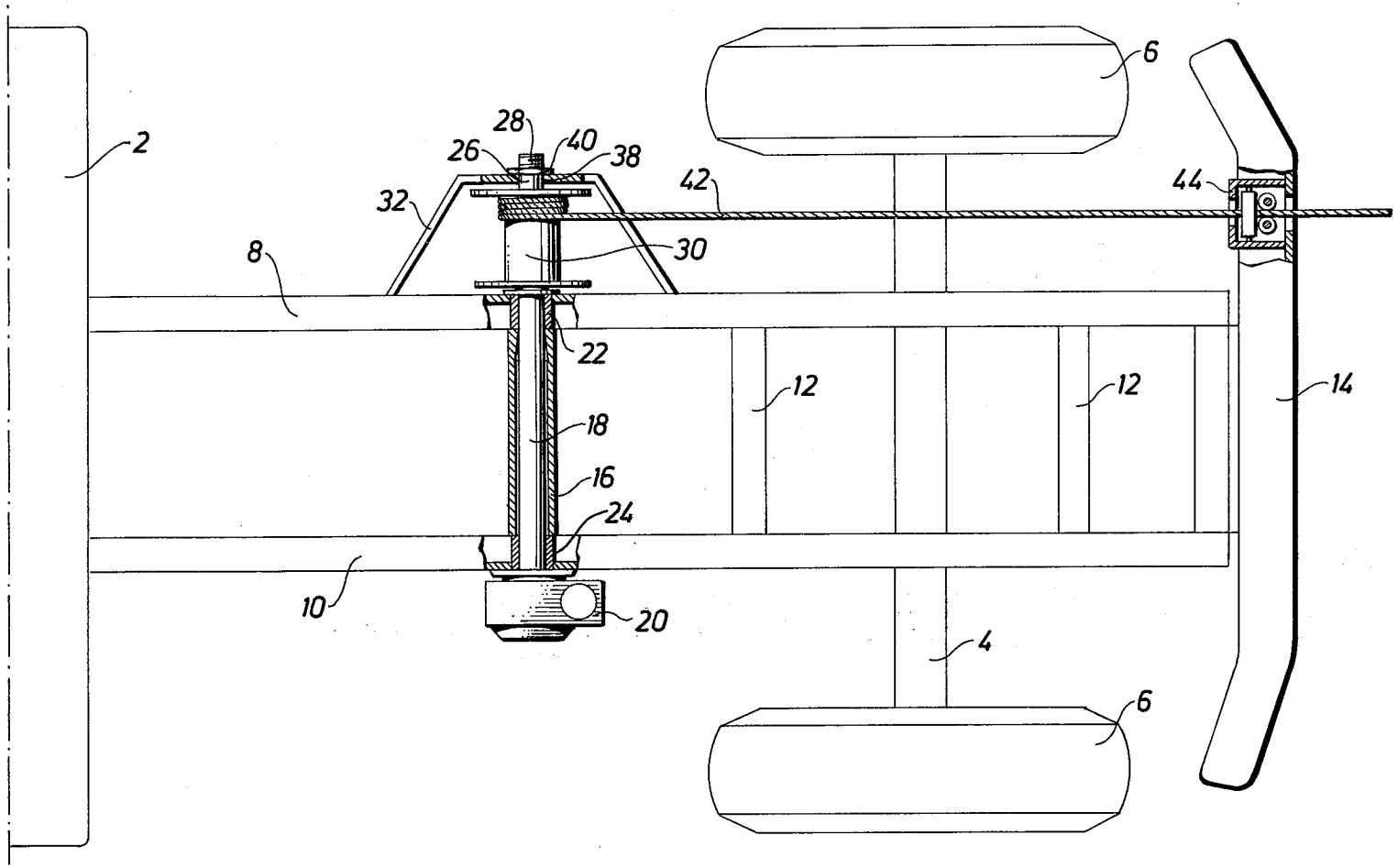
14
44
6
12
6
4
12
42
30
38
40
28
26
22
18
16
24
20
32
10
8
2

VEHICLE WINCH

The present invention relates to a vehicle winch of the type comprising a cable drum and a winch operating device which is in driving engagement with the winch drum via transmission means which extend substantially perpendicularly to the longitudinal direction of the vehicle.

It is previously known to mount winches on vehicles both at the front and rear of the vehicle and on the side thereof. The advantage obtained with a winch mounted on one side of the vehicle, for example on a longitudinally extending beam on the vehicle chassis, is that the winch can be used to lift objects in front of and behind the vehicle, without it being necessary to move the winch relative the chassis.

Present day winches which are mounted on one side of a vehicle, however, are encumbered with a number of disadvantages, since the winch operating device, which is normally a hydraulic motor or an electric motor, and the cable drum are mounted on one of the longitudinally extending beams of the vehicle chassis, in a manner such that said device and said drum extend excessively perpendicularly to the long axis of the vehicle, thereby limiting the possibilities of selective positioning of the winch along the vehicle beam. This is particularly true when the drum and the winch operating device are placed as a unit externally of the side beam. Furthermore, this arrangement of the winch and the operating device make it difficult to reach the different parts of the winch and, above all, it is not possible to give a winch mounted on a vehicle side beam sufficient stability, since correctly dimensioned bearings cannot be arranged on the beam, since otherwise the beam would be excessively weakened. Furthermore, the distribution of weight and tension loads becomes unfavourable when only one of the two vehicles side beams support the drum and winch operating device, this beam being subjected to the loads caused by the object being lifted by the winch.

An object of the present invention is to eliminate or to substantially reduce the disadvantages encountered with previously known vehicle winches. Accordingly the vehicle winch of the present invention is mainly characterized in that the winch drum and the winch operating device are each arranged externally of a respective beam extending in the longitudinal direction of the vehicle, and in that the drum and/or the winch operating device are removably mounted to the transmission device.

So that the invention will be more readily understood and further features thereof made apparent, a vehicle winch constructed in accordance with the invention will now be described by way of example only with reference to the accompanying drawing, the single FIGURE of which is a top plan view, partially in section, of a winch according to the invention.

In the drawing there is shown a vehicle, such as a lorry, comprising a cabin 2, a rear axle 4 having two wheels 6 mounted thereon, a chassis having two side beams 8 and 10 and a number of transverse beams 12 riveted to the side beams, and a rear bumper or fender 14. Extending between the side beams 8 and 10 and between the wheels 6 and the cabin 2 is a tube 16 which may be of square cross section and which accommodates, and therefore protects, a shaft 18; the tube 16 may be secured to the side beams 8 and 10 as by welding, and may comprise an original transverse beam of the vehicle. The shaft 18 is either securely connected to or detachably connected to a motor 20 for operating the winch, said motor being mounted to the beam 10 and being driven from a power output device (not shown) located in the vehicle. The shaft 18 is mounted in two slide or roller bearings 22 and 24 which are located in the side beams 8 and 10. The shaft 18 is provided at its end remote from the motor 20 with splines 26 and threads 28. A cable drum 30 whose center hole is provided with splines (not shown) along the whole length thereof is mounted on the portion of the shaft 18 provided with splines 26. A U-shaped support beam 32 is securely screwed to the side beam 8 and serves to protect the drum 30 and as an additional bearing point at 38 for the shaft 18. A nut 40 is threaded on the threaded end of the shaft 18 and abuts the beam 32. A wire or rope 42 is attached to the drum 30 and is passed over or under the support beam 32. The rear fender 14 is provided with horizontally and vertically arranged rollers 44 which are intended for the rope 42 and which take up oblique loads.

When dismantling the winch, the nut 40 is removed from the threads 28 of the shaft 18 whereafter the motor 20 with the shaft 18 can be withdrawn through the tube 16. The cable drum 30 is released thereby and can be lowered down onto the ground, for example. The winch is assembled in the reverse order of steps.

As will be evident from the aforegoing and from the drawing, there is provided a vehicle winch whose cable drum and winch operating device are arranged externally of the two outer vehicle side beams, with which arrangement the load exerted on the winch is distributed over both the side beams and the winch components are readily reached for exchange and servicing purposes. Furthermore, the winch is supported by at least two bearing points and the cable drum and the motor can be readily moved from one vehicle to another.

Although the invention has been described with reference to a particular embodiment thereof it is not restricted to this embodiment but can be modified within the scope of the accompanying claim. Thus, the motor 20 may be detachably mounted to the shaft 18 and the drum 30 may form a non-dividable unit with the shaft 18, Alternatively, both the drum and the motor may be detachably mounted to the shaft. The support beam 32 may be omitted and the motor 20 may be provided with a beam similar to the support beam 32. Furthermore, although with the described embodiment the winch operating device has the form of a motor, it will be readily perceived that any appropriate winch operating device may be used.

I claim:

1. A combination of a vehicle having a frame with a pair of side beams and a vehicle winch comprising a cable drum and a winch operating device arranged in operating engagement with said cable drum via a transmission shaft which extends substantially perpendicularly to the longitudinal axis of the vehicle, and bearings positioned in said side beams operatively engaging said transmission shaft, the cable drum and the winch operating device being arranged externally of different ones of said side beams and at least one of the cable drum and the winch operating device being detachably mounted to said shaft, a tube or a transverse beam at least partially encircles the shaft between the side beams, and wherein said tube or said transverse beam comprises one of the original vehicle frame transverse beams.

2. A combination of a vehicle having a frame with a pair of side beams and a vehicle winch, comprising, a cable drum, a transmission shaft which extends substantially perpendicular to the longitudinal axis of the vehicle, a winch, said winch arranged in operating engagement with said cable drum via said transmission shaft, bearings, said bearings located in said side beams and operatively engaging said transmission shaft, said transmission shaft extending laterally from each said side beam of the vehicle frame, each said cable drum and said winch operating device located externally of different ones of each said side beam, at least one of said cable drum and said winch operating device detachably mounted to said transmission shaft, a support beam, said support beam substantially U-shaped in horizontal section and having a base portion, the ends of said support beam secured to a side beam so that said support beam extends laterally therefrom, said support beam base portion engaging the end of said transmission shaft adjacent to said cable drum so that an additional bearing support is provided for said transmission end.

3. A vehicle winch according to claim 2, wherein at least one end of said shaft and at least one of said cable drum and said winch operating device are provided with splines.

4. A vehicle winch according to claim 2, wherein said bearings are slide or roller bearings.

5. A vehicle winch according to claim 4, wherein a tube or a transverse beam at least partially encircles said transmission shaft between the side beams.

6. A vehicle winch according to claim 5, wherein said tube or said transverse beam comprises one of the original vehicle frame transverse beams.

7. A vehicle winch according to claim 5, wherein said winch operating device is a motor, bore walls in said side beams, and said slide or roller bearings fixedly supported by said bore walls.

* * * * *